United States Patent [19]

Sapre

[11] Patent Number: 5,059,305

[45] Date of Patent: Oct. 22, 1991

[54] MULTISTAGE FCC CATALYST STRIPPING

[75] Inventor: Ajit V. Sapre, W. Berlin, N.J.

[73] Assignee: Mobil Oil Corporation, Fairfax, Va.

[21] Appl. No.: 649,280

[22] Filed: Jan. 30, 1991

Related U.S. Application Data

[63] Continuation of Ser. No. 509,455, Apr. 16, 1990, abandoned.

[51] Int. Cl.[5] ..... C10G 11/18

[52] U.S. Cl. ..... 208/113; 208/150; 208/151; 208/159; 208/160; 208/164; 585/324; 585/661; 502/41

[58] Field of Search ..... 208/78, 113, 150, 164, 208/159, 160, 151; 585/660, 661; 502/41

[56] References Cited

U.S. PATENT DOCUMENTS

| | | | |
|---|---|---|---|
| 2,377,935 | 6/1945 | Gunness | 196/52 |
| 2,386,491 | 10/1945 | McOmle | 196/52 |
| 2,397,352 | 3/1946 | Hemminger | 260/683.3 |
| 2,492,948 | 1/1950 | Berger | 252/417 |
| 2,662,050 | 12/1953 | Moorman et al. | 196/50 |
| 3,008,896 | 11/1961 | Lawson | 208/150 |
| 3,392,110 | 7/1968 | Payne | 208/160 |
| 4,043,899 | 8/1977 | Anderson et al. | 208/161 |
| 4,070,159 | 1/1978 | Myers et al. | 23/288 E |
| 4,374,750 | 2/1983 | Vickers et al. | 252/417 |
| 4,404,095 | 9/1983 | Haddad et al. | 208/161 |
| 4,422,925 | 12/1983 | Williams et al. | 208/75 |
| 4,502,947 | 3/1985 | Haddad et al. | 208/161 |
| 4,574,044 | 3/1986 | Krug | 208/120 |
| 4,579,716 | 4/1986 | Krambeck et al. | 422/113 |
| 4,581,205 | 4/1986 | Schatz | 422/113 |
| 4,588,558 | 5/1986 | Kam et al. | 422/113 |
| 4,606,814 | 8/1986 | Haddad et al. | 208/161 |
| 4,623,446 | 11/1986 | Haddad et al. | 208/113 |
| 4,624,772 | 11/1986 | Krambeck et al. | 208/95 |
| 4,654,060 | 3/1987 | Haddad et al. | 55/424 |
| 4,693,809 | 9/1987 | Bartholic et al. | 208/159 |
| 4,724,065 | 2/1988 | Bartholic et al. | 208/159 |
| 4,737,346 | 4/1988 | Haddad et al. | 422/144 |
| 4,749,471 | 6/1988 | Kam et al. | 208/113 |
| 4,789,458 | 12/1988 | Haddad et al. | 208/164 |
| 4,812,430 | 3/1989 | Child | 502/42 |
| 4,814,068 | 3/1989 | Herbst et al. | 208/155 |
| 4,840,928 | 6/1989 | Harandi et al. | 502/41 |
| 4,851,374 | 7/1989 | Yan et al. | 502/42 |
| 4,853,187 | 8/1989 | Herbst et al. | 422/144 |
| 4,917,790 | 4/1990 | Owen | 208/113 |

OTHER PUBLICATIONS

P. B. Venuto et al., Fluid Catalystic Cracking with Zeolite Catalysts, Marcel Dekker, N.Y., 1978.

*Primary Examiner*—Anthony McFarlane
*Attorney, Agent, or Firm*—Alexander J. McKillop; Charles J. Speciale; Robert B. Furr, Jr.

[57] ABSTRACT

Operational flexibility of a fluid catalytic cracking process is improved by directly cooling regenerated catalyst in an external catalyst cooler/stripper (ECCS). Regenerated catalyst withdrawn from the catalytic cracking unit regenerator is mixed with spent catalyst from the reactor stripper to effect desorption of cracked products from the spent catalyst at elevated temperature. The catalyst mixture is then contacted with an alkane-containing feedstream in a fluid bed maintained within a central section of the external catalyst cooler/-stripper (ECCS). The mixture of spent and regenerated catalyst, cooled by the endothermic dehydrogenation of the alkanes, then flows downward through the ECCS to a lower section of the ECCS where the catalyst is countercurrently stripped with steam to remove remaining entrained hydrocarbons. Steam is withdrawn from an upper section of the steam stripping zone and bypassed around the dehydrogenation/stripping and mixing stages to avoid steam deactivation of the catalyst. The cooled, stripped catalyst mixture is then charged to the regenerator for further processing.

10 Claims, 2 Drawing Sheets

MULTISTAGE FCC CATALYST STRIPPING

This is a continuation of copending application Ser. No. 509,455, filed on Apr. 16, 1990 now abandoned.

FIELD OF THE INVENTION

This invention relates to fluid catalytic cracking and more particularly to stripping cracked hydrocarbons from spent cracking catalyst and cooling the catalytic cracking process regenerator. More particularly, the invention relates to an improved three-stage process for stripping entrained hydrocarbons from spent cracking catalyst prior to regeneration while concurrently cooling catalyst withdrawn from the regenerator by endothermically dehydrogenating an alkane-containing feedstream.

BACKGROUND OF THE INVENTION

The fluid catalytic cracking (FCC) process has become well-established in the petroleum refining industry for converting higher boiling petroleum fractions into lower boiling products, especially gasoline.

In the fluid catalytic process, a finely divided solid cracking catalyst is used to promote the cracking reactions which take place in the feed. The catalyst is used in a very finely divided form, typically with a particle size range of 20–300 microns, with an average of about 60–75 microns, in which it can be handled like a fluid (hence the designation FCC) and in this form it is circulated in a closed cycle between a cracking zone and a separate regeneration zone. In the cracking zone, hot catalyst is brought into contact with the feed so as to effect the desired cracking reactions after which the catalyst is separated from the cracking products which are removed from the cracking reactor to the associated fractionation equipment for separation and further processing. During the cracking reaction, coke is deposited on the catalyst. This deposit of coke masks the active sites and temporarily deactivates the catalyst. Such temporarily deactivated catalyst is commonly called spent catalyst. The catalyst must then be regenerated before it can be reused. Fortunately, the coke deposit can be made to serve a useful purpose. Cracking is an endothermic reaction. Although, in principle, heat could be supplied by raising the temperature of the hydrocarbon feed prior to contact with the catalyst, this would thermally crack the feed so that very little control could be effected over the product distribution. Additionally, the coke formed would deposit on furnace tubes and other equipment used for heating and conveying the feed to the cracker, causing operational problems. For this reason, it is generally preferred to supply the heat to the cracking reaction by means of the catalyst. The feed may, however, be preheated to a certain degree in order to maintain an appropriate heat balance in the cycle.

Heat for the catalytic cracking process is supplied by the regeneration step in which the spent catalyst is subjected to oxidatively regenerated to remove the coke. This coke-burning step is strongly exothermic and raises the regenerated catalyst temperature such the sensible heat imparted to the catalyst during regeneration is sufficient to supply the endothermic heat of reaction for the cracking step.

The regeneration takes place in a separate regenerator vessel. Catalyst is maintained in a fluidized bed in a lower section of the regenerator vessel and an oxygen-containing gas, usually air, flows through a distribution grid which is designed to provide efficient mixing of air with the spent, coked catalyst. During the regeneration step, the coke on the spent catalyst is oxidized and the heat from the oxidation is transferred to the catalyst to raise its temperature to the requisite level for continuing the cracking reactions. The hot, freshly-regenerated catalyst is then returned to the cracking zone for contact with further feed together with any recycle. Thus, the catalyst circulates continuously in a closed cycle between the cracking zone and the regenerating zone with heat for the endothermic cracking reactions being supplied in the regenerator by oxidative removal of the coke deposits which are laid down during the cracking portion of the cycle. In order to maintain the desired level of catalyst activity and selectivity, a portion of the circulating inventory of catalyst may be withdrawn intermittently or continuously with fresh, make-up catalyst being added to compensate for the withdrawn catalyst and the catalyst losses which occur through attrition and loss of catalyst from the system.

A further description of the catalytic cracking process and the role of regeneration may be found in the monograph, "Fluid Catalytic Cracking With Zeolite Catalysts", Venuto and Habib, Marcel Dekker, N.Y., 1978. Reference is particularly made to pages 16–18, describing the operation of the regenerator and the flue gas circuit.

The amorphous cracking catalysts which were initially used in the FCC process were characteristically low activity catalysts which gave a relatively low hydrocarbon conversion with a relatively low carbon lay-down on the catalyst. Because the carbon provides the heat for the regeneration process, the carbon lay-down is a measure of the heat which can be produced during the regeneration and, consequently, of the regeneration temperature. Thus, the use of amorphous catalysts implied the use of relatively low regeneration temperatures.

The development of synthetic zeolite cracking catalysts, especially the zeolite cracking catalysts represented mainly by the synthetic faujasite zeolite Y, typically in the form of rare earth exchanged zeolite Y (REY) or ultrastable Y (USY) represented a considerable advance in the technology of the FCC process, but it was accompanied by its own problems. In contrast to the older, amorphous cracking catalysts which they rapidly supplanted, the zeolite catalysts were characterized as relatively high conversion catalysts which produced a relatively high carbon lay-down on the catalyst. The relatively higher carbon lay-down resulted in higher regenerator temperatures and higher burning rates both for the carbon on the catalyst and for the carbon monoxide produced during the combustion process. With the production of greater heat in the regenerator, the catalyst circulation rate was reduced since the process as a whole needs to remain in a heat balanced condition and this was desirable since it enabled the catalyst make-up rate to be reduced, a valuable economic factor.

The zeolite cracking catalysts are, in general terms, more sensitive to residual carbon than the amorphous catalysts, particularly with respect to selectivity. This sensitivity, coupled with the fact that operation under high temperature regeneration conditions was desirable for other reasons, as indicated above, provided an incentive for higher regenerator temperatures and lower residual carbon levels on the regenerated catalyst.

However, it has been found that the most desirable conversion selectivity may be obtained, and more difficult feeds may be processed, by introducing the regenerated catalyst to the fresh feed at a temperature below that determined by the metallurgical limitations of the regenerator. In other words, while the regenerated catalyst upper temperature limit is determined by the maximum safe operating temperature in the catalyst regenerator, the optimum catalyst temperature for the conversion process is generally accepted to be a lower temperature.

Viewing the regenerator as a controlled combustion chamber, it can be seen that the operating temperature may be lowered by decreasing net heat input or by withdrawing heat from the vessel. Heat input sources for the regenerator vessel include sensible heat is from the spent catalyst, as well as heat generated within in the vessel from the combustion of coke and entrained hydrocarbon products. Thus operating temperature could effectively be lowered in the regenerator vessel by decreasing spent catalyst flow, decreasing fuel flow, or by cooling the regenerator by direct or indirect heat exchange. However, the rate of catalyst circulation is substantially set by the cracking feedstock flowrate to the riser reactor and the desired conversion, thus practically limiting regenerator temperature control methods to reducing fuel flow and cooling via heat exchange.

The coke deposited on spent cracking catalyst together with entrained product carried over to the regenerator with the spent catalyst is referred to by those skilled in the art as "total delta carbon". For a given FCC unit design, at a fixed catalyst circulation rate, an increase in total delta carbon is accompanied by higher regenerator temperatures. Consequently, one method of limiting FCC regenerator temperature is to reduce total delta carbon by reducing carryover of cracked hydrocarbon product to the regenerator.

Recent research efforts in the field of FCC technology have contributed new processes and devices for efficiently separating catalyst particles from a fluidized suspension phase, as exemplified by the following references.

U.S. Pat. No. 4,070,159 to Myers et al. provides means for separating cracking catalyst from cracked product in which the bulk of catalyst solids is discharged directly into a settling chamber without passing through a cyclone separator. However, the Myers et al. process strips hydrocarbon product from the spent catalyst using hot flue gas; See column 10, lines 12–18. Cracked products could be burned in contact with oxygen-containing flue gas at elevated temperature, thus decreasing the net product yield from the cracking process.

U.S. Pat. No. 4,574,044 to Krug discloses a method for increasing the overall efficiency of an FCC process by decreasing the amount of valuable product burned in the regenerator. Separation of catalyst from hydrocarbon product is enhanced by first stripping the hydrocarbon product from the catalyst and then conditioning the catalyst in the presence of steam at elevated temperatures for a period of about ½ to 30 minutes. The benefits of this system include a reduction in coke make.

The FCC process converts petroleum feedstocks in the gas oil boiling range to lighter products such as gasoline. While a wide variety of catalysts may be used in the catalytic cracking process, most preferred is a zeolite cracking catalyst which exhibits loss of catalytic activity when coked. Thus a substantial quantity of coke must be removed from the catalyst when it is regenerated. As a result, regenerators are designed to be "hot-operated" and under pressure, that is, operated at a pressure in the range from about 25 psig to 40 psig, and as high a temperature as is practical from a materials standpoint. The temperature within a regenerator typically ranges from about 538° C. to about 815° C. (1000–1500° F.).

Examples of FCC regenerators with catcoolers are disclosed in U.S. Pat. Nos. 2,377,935; 2,386,491; 2,662,050; 2,492,948; and 4,374,750, inter alia. These catcoolers remove heat by indirect heat exchange, typically a shell and tube exchanger. None removes heat by direct heat exchange, for example, by continuously diluting hot regenerated catalyst with cold catalyst, or by blowing cold air through the hot catalyst; more particularly, none removes heat by functioning as a reactor which supplies heat to an endothermic reaction.

U.S. Pat. No. 4,422,925 discloses the step-wise introduction of ethane, propane, butane, recycle naphtha, naphtha feed, raffinate naphtha, and fractionator bottoms recycle in the riser reactors of a FCC unit. In the riser reactors, the lower alkanes are contacted, in a transport zone, with hot regenerated catalyst which would dehydrogenate the alkanes, progressively decreasing the temperature of the suspension of catalyst and hydrocarbons as they progress upwards through the risers. The mixture of catalyst and reaction products is then contacted with a hydrocarbon feedstock suitable for catalytic cracking, such as virgin naphtha, virgin gas oil, light cycle gas oil, or heavy gas oil. (see col 2, lines 29–33). This contrasts with the present process which concurrently strips entrained hydrocarbons from spent catalyst while cooling hot regenerated catalyst.

The concept of cooling hot regenerated catalyst by using an endothermic reaction, specifically the catalytic dehydrogenation of butane, is taught in U.S. Pat. No. 2,397,352 to Hemminger. While the teachings of the Hemminger patent are wholly unrelated to operation of a FCC unit, regeneration of the catalyst was required before it was returned to the dehydrogenation reactor. The Hemminger patent teaches the use of a catalyst (chromic oxide supported on alumina or magnesia) heating chamber for supplying heat to the dehydrogenation reaction, and to preheat, at least in part, the butane to raise its temperature to reaction temperatures.

U.S. Pat. No. 4,840,928 to Harandi and Owen teaches a fluid catalytic cracking process in which catalyst withdrawn from the regenerator is cooled by direct contact with an alkane-rich stream in an external catalyst cooler. However, the Harandi and Owen process differs from the process of the present invention in that the Harandi and Owen process teaches a single stage dehydrogenation reactor in which only the hot regenerated cracking catalyst contacts the alkane-rich stream. In contrast, the present invention provides a three-stage catalyst cooling and steam stripping process which efficiently strips hydrocarbons from spent cracking catalyst while cooling the regenerated catalyst in controlled stages to minimize steam deactivation of the catalyst.

SUMMARY OF THE INVENTION

The process of the present invention improves the operational flexibility of a fluid catalytic cracking process by a three-stage process for stripping spent catalyst and for cooling the regenerator. The process of the present invention includes three sequential stages, and their order is critical to the effectiveness of the process. The process is suitably conducted in a partitioned vessel physically separate from the catalytic cracking unit regenerator and reactor vessels.

In the first stage, spent catalyst withdrawn from the reactor vessel is admixed with hot regenerated catalyst withdrawn from the regenerator vessel. This admixing step raises the spent catalyst temperature to effect desorption of at least a portion of the entrained cracked product.

Next, the mixture of spent and regenerated catalyst flows to a dehydrogenation/stripping zone where an added $C_2$–$C_4$ alkane-rich stream countercurrently strips entrained heavier cracked products from the catalyst mixture. The alkane-rich stream endothermically dehydrogenates in the dehydrogenation/stripping zone thus cooling the catalyst mixture.

Finally, the cooled catalyst mixture flows to a steam stripping stage where it is countercurrently stripped with upwardly flowing steam. The cooled, stripped catalyst then returns to a lower section of the regenerator for further processing.

More specifically, the process encompasses an improved method for stripping and regenerating spent cracking catalyst in a fluidized catalytic cracking process comprising the steps of:

(a) cofeeding active hot solid zeolite cracking catalyst and crackable hydrocarbon feed to a cracking zone;

(b) cracking said feed to hydrocarbon products while depositing coke on said catalyst to evolve spent catalyst;

(c) disengaging said spent catalyst from said hydrocarbon products;

(d) flowing said spent catalyst to a regeneration zone;

(e) passing an oxygen-containing gas upwardly through said regeneration zone at sufficient velocity to fluidize said catalyst contained within said regeneration zone;

(f) retaining said catalyst in said regeneration zone at elevated temperature for a time sufficient to effect exothermic oxidative regeneration of said catalyst by burning said coke deposited thereon, thereby heating and reactivating said catalyst;

(g) providing a catalyst stripping zone comprising three superimposed stages, said stages comprising an upper mixing stage, a central dehydrogenation/stripping stage, and a lower steam stripping stage;

(h) mixing spent catalyst of step (c) with regenerated catalyst of step (f) in said upper mixing stage of said catalyst stripping zone;

(i) retaining said mixture of step (h) within said upper mixing stage at elevated temperature for a period of time sufficient to effect desorption of cracked products from said spent catalyst;

(j) flowing said catalyst mixture of step (i) downwardly to said central dehydrogenation/stripping zone;

(k) introducing a stream containing $C_2$–$C_4$ alkanes to a lower section of said central dehydrogenation/stripping zone and flowing said stream containing $C_2$–$C_4$ alkanes upwardly in countercurrent contact with said catalyst mixture at superficial velocity adequate to maintain said catalyst in a state of sub-transport fluidization, and to strip cracked products from said spent catalyst while providing sufficient contact time between said catalyst mixture and said $C_2$–$C_4$ alkane-containing stream to cool said catalyst mixture by endothermically dehydrogenating at least a portion of alkanes present in said central dehydrogenation/stripping zone to evolve a dehydrogenated product stream;

(l) flowing said cooled catalyst mixture of step (k) from said central dehydrogenation/stripping stage downwardly to said lower steam stripping zone and flowing said dehydrogenated product stream upwardly to said upper mixing stage;

(m) introducing steam to a bottom portion of said lower steam stripping stage and flowing said steam upwardly at superficial gas velocity sufficient to fluidize said catalyst mixture and to countercurrently steam strip said downwardly flowing catalyst mixture to remove hydrocarbons from said catalyst mixture;

(n) withdrawing steam and stripped hydrocarbons from an upper portion of said lower steam stripping stage to prevent substantial flow of steam and stripped hydrocarbons upward from said lower steam stripping stage to said central dehydrogenation/stripping stage.

DETAILED DESCRIPTION OF PREFERRED EMBODIMENTS

Figure 1:
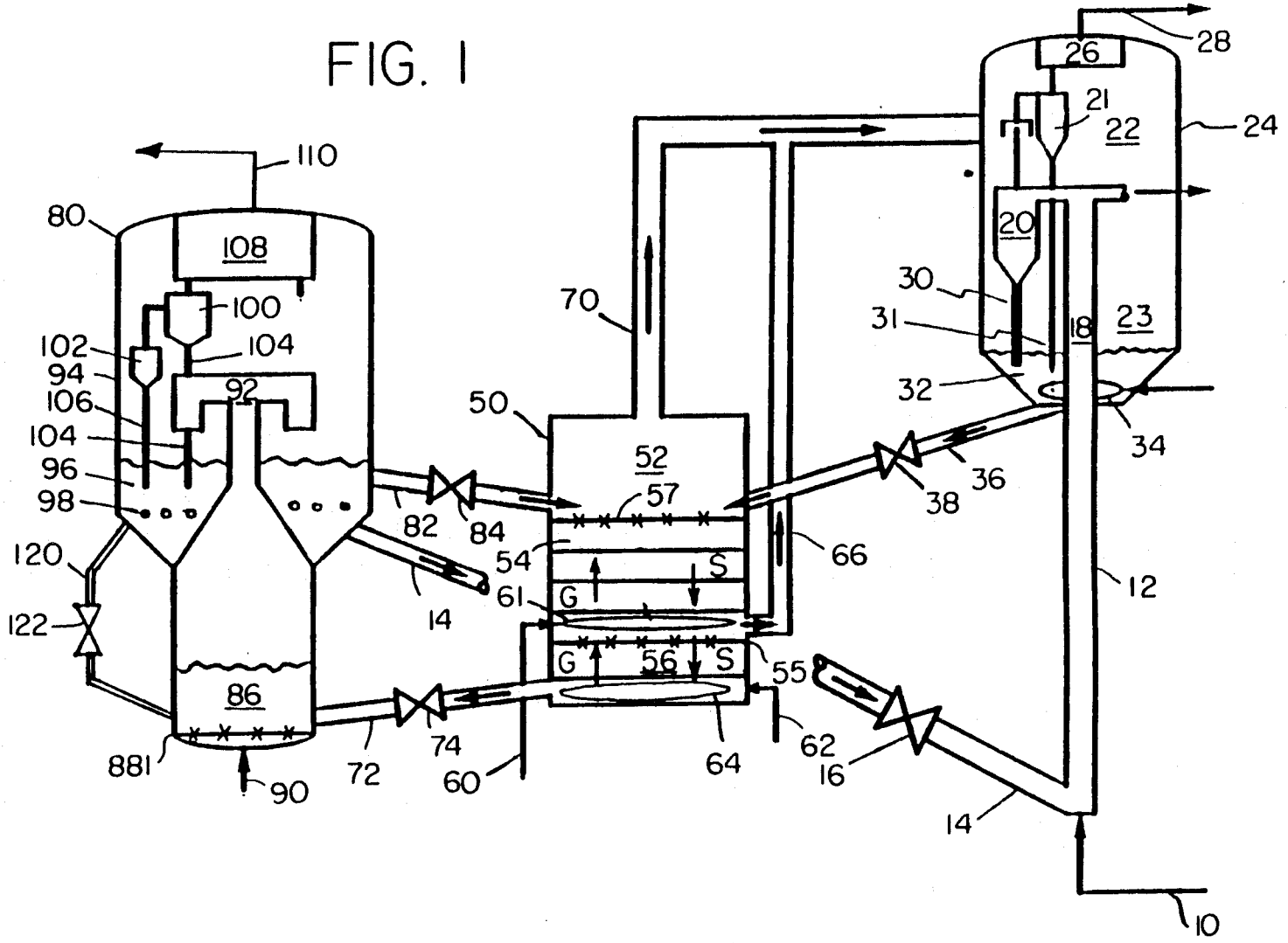
FIG. 1 is a simplified schematic representation of major processing steps in the catalytic cracking process of the present invention.

In a preferred embodiment, the process of this invention is carried out with a cracking catalyst consisting essentially of large pore crystalline silicate zeolite, generally in a suitable matrix component. The particular cracking catalyst used is not critical to initiate the dehydrogenation reaction, since part of the reaction is due to thermal cracking. The product yield and selectivity, however, are affected by the catalyst type and its metal content. Most preferred is a rare earth-promoted FCC catalyst in which additional metal promoters, particularly nickel and vanadium, are laid down by the vacuum gas oil (VGO) or resid feed to the FCC riser, and the metals are oxidized in the regenerator. In addition, the FCC catalyst may contain a small amount of Pt, usually less than 300 ppm, to boost the oxidation of CO to $Co_2$ in the regenerator. Since control of the distribution of products from the FCC is much more important than control of the distribution of products obtained by dehydrogenation, the preferred catalyst the present process is the FCC catalyst of choice.

Conventional non-zeolitic FCC catalysts may be used which are generally amorphous silica-alumina and crystalline silica-alumina. Other non-zeolitic materials said to be useful as FCC catalysts are the crystalline silicoaluminophosphates of U.S. Pat. No. 4,440,871 and the crystalline metal aluminophosphates of U.S. Pat. No. 4,567,029. However, the most widely used FCC catalysts are large pore crystalline silicate zeolites known to possess some catalytic activity with particular respect to converting lower alkanes to alkenes, and specifically propane to propylene, at a temperature and pressure lower than those at which the regenerator of the FCC unit operates. Such zeolites typically possess an average (major) pore dimension of about 7.0 angstroms and above. Representative crystalline silcate zeolite cracking catalysts of this type include zeolite X (U.S. Pat. No. 2,882,244); zeolite Y (U.S. Pat. No. 3,130,007); zeolite ZK-5 (U.S. Pat. No. 3,247,195); zeolite ZK-4 (U.S. Pat. No. 3,314,752), merely to name a few, as well as naturally occurring zeolites, such as chabazite, faujasite, modernite, and the like. Also useful are the silicon-substituted zeolites described in U.S. Pat. No. 4,503,023. Zeolite Beta is yet another large pore crystalline silicate which can constitute a component of the mixed catalyst system herein.

Most preferred is a large-pore crystalline silicate zeolite promoted with a catalytic amount of metal or metal oxide of an element selected from Groups V and VIII of the Periodic Table, sufficient to enhance the dehydrogenation activity of the FCC catalyst.

Combinations of two or more of the catalysts listed above may also be used. In addition to the foregoing catalysts, a mixed catalyst system in which a catalyst requiring frequent regeneration, such as zeolite Y, may be employed in combination with a shape-selective medium-pore crystalline silicate zeolite catalyst requiring comparatively infrequent regeneration such as ZSM-5, as disclosed in U.S. Pat. Nos. 4,861,741 and 4,822,477, the disclosures of which are incorporated by reference thereto as if fully set forth herein.

The term "catalyst" as used herein shall be understood to apply not only to a caralytically active material but to one which is composited with a suitable matrix component which may or may not itself be catalytically active. By "cracker or cracking catalyst" we refer to any catalyst used in a fluid cracker which catalyst has some propane- or butane-dehydrogenation activity under the pressure and temperature conditions specified for operation of the ECCS.

The FCC unit is preferably operated under fluidized flow conditions, at a temperature in the range from about 1000° F. to about 1350° F., with a catalyst-to-charge stock ratio of from about 4:1 to about 20:1, and a contact time of from about 1 to about 20 sec. Generally, it is preferred to crack the charge stock in an upflowing riser conversion zone discharging into cyclonic separation means in an upper portion of an enlarged vessel in which the products of cracking are separated from catalyst.

Preferred charge stocks to the cracker comprise petroleum fractions having an initial boiling point of at least 500° F. (260° C.), a 50% point at least 750° F. (399° C.), and an end point of at least 1100° F. (593° C.). Such fractions include gas oils, thermal oils, residual oils, cycle stocks, whole top crudes, tar sand oils, shale oils, synthetic fuels, heavy hydrocarbon fractions derived from the destructive dehydrogenation of coal, tar, pitches, asphalts, hydrotreated feedstocks derived from any of the foregoing, and the like. As will be recognized, the distillation of higher boiling point fractions above about 750° F. (399° C.) must be carried out under vacuum to avoid thermal cracking. The boiling temperatures utilized herein are expressed, for convenience, in terms of the boiling point corrected to atmospheric pressure.

Referring now to FIG. 1, there is schematically illustrated a flowsheet in which a charge stock (feed), such as gas oil having a boiling range of about 600–1200° F., or 315–676.7° C.), flows through line 10, after it is preheated, into riser 12, near the bottom. Thus, the gas oil is mixed with hot regen catalyst, such as zeolite Y, introduced through a valved conduit means, such as lower regenerated catalyst standpipe 14 provided with a flow control valve 16. Because the temperature of the hot regenerated catalyst is in the range from about 1200° F. (676.7° C.) to about 1350° F. (732.2° C.), a suspension of hydrocarbon vapors is quickly formed and flows upward through the riser 12.

The riser 12 is sized to afford the catalyst and reactants the contact time preselected to convert the feedstock to the desired cracked products. The upper portion 18 of the riser 12 may optionally be flared outward to achieve the desired residence time. Catalyst particles and the gasiform products of conversion continue past the upper portion 18 of the riser 12 and are discharged from the top of the riser into one or more cyclone separators 20 and 21 (only two are designated), housed in the upper portion 22 of the vessel, which upper portion is indicated generally by reference numeral 24. Riser 12 terminates in an open end "T" connection which may be fastened to the riser discharge. In the most preferred embodiment, the outlet of riser 12 is operatively connected to a series of closed cyclones as taught in U.S. Pat. Nos. 4,043,899 to Anderson, 4,404,095 to Haddad 4,502,947 to Haddad 4,579,716 to Krambeck, 4,581,205 to Schatz, 4,588,558 to Kam, 4,606,814 to Haddad, 4,623,446 to Haddad, 4,624,772 to Krambeck, 4,654,060 to Haddad, 4,737,346 to Haddad, or 4,749,471 to Kam, each of which is incorporated by reference as if set forth at length herein for details of closed cyclone catalyst separation systems.

The effluent from riser 12 comprises catalyst particles and hydrocarbon vapors which are led into the cyclonic separators 20 and 21 to effect separation of catalyst from hydrocarbon vapors. These vapors pass into a plenum chamber 26 and are removed through conduit 28 for recovery and further processing, typically to a fractionator column where the products of cracking are separated into preselected fractions. While two cyclones 20 and 21 are illustrated in series, it is to be understood that two or more parallel sets of such cyclones in series may be operatively connected between the outlet of riser 12 and plenum chamber 26. The particular type or number of cyclone separators is not critical to the operation of the present invention, except to the extent that the resulting separation of catalyst and cracked products is sufficient for economic unit operation.

Catalyst separated from the vapors descends through diplegs 30 and 31 to a fluid bed 32 of catalyst maintained in the lower portion 23 of the reactor vessel 24. Steam may optionally be introduced into the fluid bed 32 through steam ring 34 at a flowrate sufficient to maintain sub-transport fluidization. Some of the entrained hydrocarbon products may be desorbed from the catalyst at this point, however, the bulk of the stripping duty in the present process is preferably carried by the ECCS.

The steam and desorbed hydrocarbons pass through one or more cyclones 20 and 21 which return catalyst fines through diplegs 30 and 31 to the bed 22. Spent catalyst flows though spent catalyst standpipe 36, provided with flow control valve 38, to the upper mixing section of external cooler/stripper vessel 50, hereinafter referred to as the ECCS. The spent catalyst leaves the reactor vessel 24 at a temperature from about 480 to about 650° C. (900° to 1200° F.), typically about 540° C. (1000° F.). The ECCS is coupled to the regenerator 80 through the catalyst transfer lines but is physically located externally relative to both the regenerator and the catalytic cracking unit reactor. Hot regenerated catalyst from the regenerator 80 flows through upper regenerated catalyst standpipe 82 which is equipped with flow control valve 84 and also enters the upper mixing section of ECCS 50 where it is admixed with the cooler spent catalyst. The temperature at which the regenerated catalyst enters the ECCS is a function of regenerator operating temperature, and is preferably within the range of from about 650° to about 790° C. (1200° to 1450° F.).

The regenerator 80 may suitably comprise any configuration which effects a controlled coke burn to reduce residual coke on the regenerated catalyst to less than about 0.1 weight percent. The most preferred regenerator configuration is a multistage regenerator as exemplified by the illustration of FIG. 1 and taught in U.S. Pat. Nos. 4,812,430 to Child, 4,814,068 to Herbst, 4,851,374 to Yan et al., and 4,853,187 to Herbst et al., which disclosures are incorporated by reference as if set forth at length herein for the details of multistage FCC regenerators.

The ECCS 50 contains three distinct stages during process operation. The upper section of the ECCS is a mixing stage 52 for admixing catalyst withdrawn from the regenerator and spent catalyst from the reactor. This upper section may optionally include baffles to enhance stripping of the cracked product from the spent catalyst. However, baffles are not essential to the function of the upper mixing stage 52. The primary purpose of the upper mixing stage is to provide residence time at elevated temperature to effect desorption of a portion, for example, at least about 10% by weight, of the entrained hydrocarbon products. The regenerated catalyst directly heats the spent catalyst in the upper mixing zone and the heated catalyst mixture flows generally downwardly through the mixing zone at weight hourly space velocities up to about 50 hr. $^{-1}$, based on the mixed catalyst. The relative flowrates of regenerated and spent catalyst charged to the upper mixing stage are controlled to maintain the temperature of the upper mixing zone within the range of about 950° to about 1400° F. (510° to 760° C.), typically resulting in weight ratios of regenerated catalyst to spent catalyst charged to the upper mixing stage of from about 0.5:1 to about 4:1.

The middle portion 54 of the ECCS is a dehydrogenation/stripping stage which is divided from the upper mixing stage 52 by distributor 57. Distributor 57 may comprise any suitable perforate structure which promotes relatively uniform fluid velocity across the width of ECCS 50, for example a mesh screen or drilled plate.

Mixed catalyst from the upper mixing stage flows downwardly through distributor 57 and enters the central dehydrogenation/stripping stage 54 where it contacts an upwardly flowing feedstream which enters the bottom of the central dehydrogenation/stripping stage 54 through line 60 and flow distributor 61. Preferred feedstocks include streams rich in propane and butane relative to the total weight of other hydrocarbon components. The typical feedstocks contain minor amounts of other lower alkanes and even smaller amounts of olefins scavenged from various waste refinery streams. Such preferred feedstocks contain at least 50% by weight, and more preferably 70% by weight of $C_4$- alkanes.

The mixed spent and regenerated catalyst is quickly cooled by the endothermic dehydrogenation of alkanes in the ECCS central dehydrogenation/stripping stage. The ECCS dehydrogenation/stripping stage generally operates at relatively low WHSV in the range from 0.01 to $5.0^{-1}$ hr preferably from 0.1 to $1.0^{-1}$ hr , and in a relatively narrow pressure and temperature range from above 20 psig to about 50 psig (239–446 kPa), preferably 25 psig to about 45 psig (273–411 kPa), and from about 1000° to 1200° F. (537°-649° C.) preferably 1100° F. (593° C.), respectively, depending upon the pressure and temperature at which the regenerator is operated.

The lower steam stripping stage 56 is located in the bottom section of the ECCS. Catalyst from the upper dehydrogenation/stripping stage is cooled by endothermic dehydrogenation of the alkane-rich feedstream and flows downward through the ECCS vessel into the lower steam stripping stage 56.

The dehydrogenated product stream flows upward through the dehydrogenation/stripping and mixing stages and is separated from entrained catalyst via suitable separation means (not shown). Examples of such separation means include one or more cyclone separators, a sintered metal filter, or a cyclone separator in series with a downstream sintered metal filter. The purified vapor product stream is then withdrawn from ECCS 50 and returned to the FCC reactor 24 through line 70, preferably to reactor 24 at a point above the dense bed of catalyst 32.

The cooled catalyst continues its downward flow through the ECCS and enters steam stripping stage 56, which may optionally be fitted with baffles. The entire length of the ECCS may be provided with baffles to increase the extent of turbulent fluidization. However, the decision to install baffles and their configuration if so installed is well within the expertise of one skilled in the art of chemical process engineering.

Stripping steam enters the bottom of the ECCS through conduit 62 and distribution grid 64, and flows upward through catalyst stripping stage 56. The contact time between the cooled catalyst and the stripping steam may be selected to effect relatively complete stripping of entrained hydrocarbons from the cooled cracking catalyst. Typical weight hourly space velocities in the lower steam stripping stage range from 0.01 to 50 $hr^{-1}$, based on catalyst.

In a preferred embodiment, steam and stripped hydrocarbons are withdrawn from an upper section of the steam stripping stage 56 through line 66 and transferred to product line 70 to be charged to the reactor vessel 24 as shown. The withdrawn steam and stripped hydrocarbons may optionally be charged directly to a product recovery section (not shown) after being passed through dedicated catalyst disengaging means such as sintered metal filters or cyclone separators (also not shown).

The cooled stripped catalyst is then withdrawn from ECCS 50 and returned to a lower section of regenerator 80 through line 72, which is equipped with valve 74. Line 72 preferably transports the catalyst from the ECCS at a point just above the steam distribution grid 64 to a lower section of regenerator 80.

A regeneration gas, typically air, is introduced into a lower fluidized dense bed 86 by distributor 88 and conduit 90. The catalyst within the regenerator is fluidized and transported upwardly through tee-shaped distribution means and enters the upper section of the regenerator, designated generally as 94. The catalyst forms an upper dense bed 96 within the upper section of the regenerator which may optionally contain secondary air distributor ring 98 (shown in cross section) which is supplied by a suitable conduit (not shown). Cyclone separators 100 and 102 are provided with diplegs 104 and 106 and separate entrained catalyst particles from the flue gas, returning the separated catalyst to the upper dense bed 96. The flue gases pass from the cyclones into plenum chamber 108 and are withdrawn for fines removal (not shown) and optional heat recovery (not shown) through line 110. Hot catalyst from upper dense bed 96 may optionally be recycled to lower dense bed 86 through line 120 which is provided with flow control valve 122, if additional heat is required to raise the temperature of lower dense bed 86 to initiate coke combustion. Regenerated catalyst is returned to the bottom of riser 12 by lower regenerated catalyst standpipe 14 which is provided with flow control valve 16.

Figure 2:
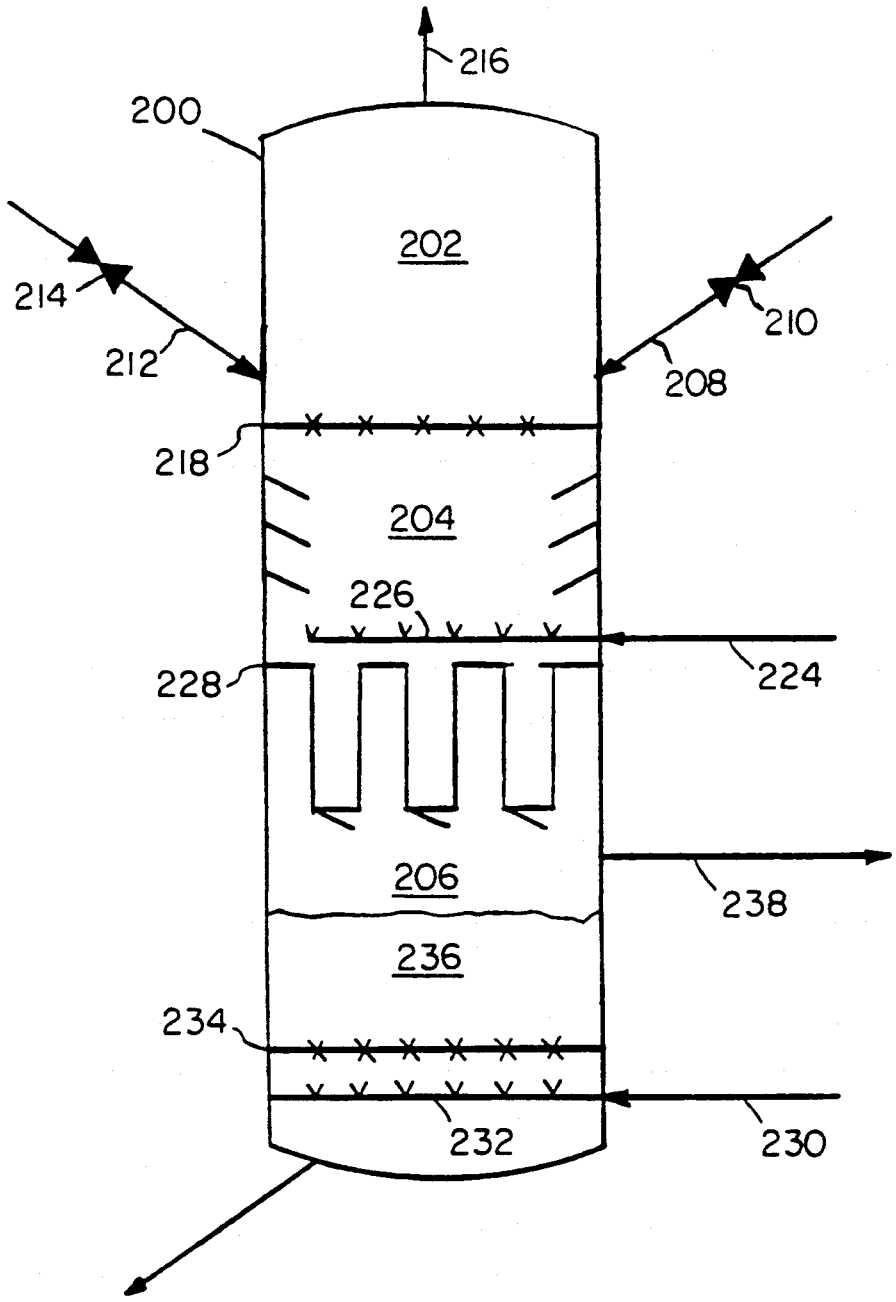
FIG. 2 shows a preferred embodiment of the External Catalyst Cooler/Stripper vessel of the present invention.

Referring now to FIG. 2, a preferred embodiment of the ECCS is described. The ECCS vessel 200 is operatively divided into three stages: an upper mixing stage 202, a central dehydrogenation/stripping stage 204, and a lower steam stripping stage 206. Spent catalyst withdrawn from a fluid catalytic cracking unit reactor vessel, as described above, enters upper mixing stage 202 through spent catalyst standpipe 208 which is fitted with flow control valve 210. Fresh, hot regenerated catalyst flows from the fluid catalytic cracking unit regenerator vessel and enters the upper mixing stage 202 through regenerated catalyst standpipe 212 and flow control valve 214.

The upper mixing stage heats the spent catalyst by directly contacting spent catalyst with hot regenerated catalyst and then retains the mixed catalyst within the mixing stage for a period of time sufficient to desorb at least a portion of the sorbed cracked products. The product stream from the dehydrogenation/stripping zone flows upwardly through the upper mixing zone 202 and carries off the desorbed hydrocarbons which are withdrawn from the ECCS vessel 200 through conduit 216.

Gas distributor 218 divides the upper mixing zone 202 from the central dehydrogenation/stripping zone 204. The distributor 218 may comprise any suitable perforate member which effectively improves the uniformity of upward gas flow between the dehydrogenation/stripping zone 204 and the upper mixing zone 202. Depending on the physical dimensions and flowrates associated with a particular ECCS, it may be desirable to select the percentage of open area and the perforation size in the gas distributor to slightly restrict downward flow of catalyst to both prolong residence time within the upper mixing stage and to improve the uniformity of the fluidization regime within the upper mixing stage.

The central dehydrogenation/stripping stage 204 preferably contains frustoconical baffles 220 and 222 (only two are designated) to enhance contact between downwardly flowing catalyst and the upwardly flowing hydrocarbons. The hydrocarbon stream introduced through line 224 and feed inlet distributor 226 is preferably enriched in $C_3$–$C_4$ alkanes, as described above, which readily dehydrogenate upon contact with the fluidized catalyst. The configuration of feed inlet distributor may be of any suitable type, with the limitation that the feed inlet distributor must impart an upward velocity to the introduced alkane-enriched stream. Accordingly, such feed inlet distributors include those comprising a plurality of radially disposed perforate tubes, or one or more perforate tube rings. The feed inlet distributor may also suitably include flow directing nozzles for discharging the alkane-enriched feedstream upwardly into the fluid bed of catalyst maintained within the central dehydrogenation/stripping stage 204.

Directing the alkane-enriched feedstream generally upward as it enters the central dehydrogenation/stripping zone is critical to the operation of the present process. Charging the alkane-enriched feedstream to the central dehydrogenation/stripping zone in a substantially downward direction would tend to upset operation of the steam flow control partition 228, as is described in greater detail below.

Lower steam stripping stage 206 receives downwardly flowing catalyst from central dehydrogenation/stripping stage 204 which catalyst has been cooled to a temperature of from about 1000 to about 1200° F.,(537–649° C.), preferably around 1100° F. (593° C.). Steam enters near the bottom of the lower steam stripping stage in a generally upward direction through conduit 230 and steam distributor grid 232. Suitable steam distributor grid configurations include perforate tubes in radial or ring arrangements as described above with reference to the feed inlet distributor 226. A secondary distributor 234 may optionally be positioned above steam distributor grid 232 to improve catalyst fluidization and contact between catalyst and the stripping steam.

While the central dehydrogenation/stripping zone effectively removes a major portion of the cracked products entrained with the spent catalyst, subsequent steam stripping is required in the present process to remove both the remaining sorbed cracked products as well as entrained dehydrogenation reaction products from the central dehydrogenation/stripping stage. Steam together with stripped hydrocarbons flows upwardly out of fluid bed 236 and is withdrawn from the lower steam stripping stage via conduit 238 to be charged directly to an upper section of a catalytic cracking unit reactor vessel (not shown) for subsequent recovery with the cracking unit product stream. Conduit 238 may optionally charge the steam and stripped hydrocarbons directly to a product recovery fractionation section (also not shown).

The sequence of operative stages within the ECCS is critical to successful process operation. Specifically, spent catalyst is first directly heated with regenerated catalyst in the upper mixing stage. The catalyst mixture is then concurrently cooled by endothermic alkane dehydrogenation and countercurrently stripped of a major portion of the entrained cracked products in the central dehydrogenation/stripping stage. Finally, the cooled catalyst mixture is countercurrently stripped with steam. Thus the steam stripping step is carried out in a lower temperature stage in contrast to the higher temperature desorption which takes place in the upper mixing zone. Elevated water partial pressure in the upper mixing stage is highly undesirable and would tend to accelerate steam deactivation of the cracking catalyst. The rate of steam deactivation, an irreversible physical degradation of the zeolite structure, is a function of water partial pressure, temperature, and exposure time. Thus it is to be clearly understood that the benefits associated with the improved stripping and catalyst cooling aspects of the present invention could readily be negated by taking the steps of the process out of the order recited herein. Specifically, it is essential that substantial stripping steam flow from the lower steam stripping stage to the central dehydrogenation/stripping stage be avoided.

Steam flow control partition 228 divides the lower steam stripping stage 206 from the central dehydrogenation/stripping stage 204 and allows catalyst to flow downwardly from the dehydrogenation/stripping stage to the steam stripping stage while limiting the upward flow of steam from the steam stripping stage into the dehydrogenation/stripping stage. The steam flow control partition 228 may comprise any suitable upward gas flow limiting partition, such as a valve tray or a plate containing a plurality of downcomers extending from the plate downwardly into the fluid bed of catalyst 236 within lower steam stripping stage 206.

The most preferred embodiment of the steam flow control partition 228 is schematically illustrated in FIG. 2. In this most preferred embodiment, the steam flow control partition comprises a plate containing a plurality of standpipes fitted with flapper or trickle valves at their lower opening. Flapper or tricle valves as used in FCC units are generally simple mechanical devices employing a horizontally hinged, flat metal plate which is biased towards a closed position at the bottom of a cylindrical conduit. Examples of suitable flapper valves are taught, for example, in U.S. Pat. Nos. 3,785,962 to Conner et al., 4,606,814 to Haddad, and 4,871,514 to Ross, which patents are incorporated herein. U.S. Pat. No. 4,446,107 to Buyan describes a flapper valve and is incorporated herein by reference for details of flapper valve construction.

The size and number of standpipes for a specific ECCS vessel may be determined by one skilled in the art with a minimum amount of trial and error to attain the desired downward catalyst flow within the ranges specified herein while minimizing upward steam flow through the partition. For example, for a 20 foot diameter ECCS vessel, a typical configuration would include from about 4 to about 8 standpipes having inside diameters of from about 2 to about 4 feet.

The quantity of heat supplied to the ECCS is determined by a controlled amount of catalyst withdrawn from the regenerator and the reactor. The relative rate at which the spent and regenerated catalyst streams are charged to the upper mixing stage depends upon the temperature at which the regenerator is to be operated, as well as upon the catalyst circulation rate, which in turn determines the amount of alkanes which may be dehydrogenated. For a given flow of spent and regenerated catalyst to the ECCS at a preselected temperature, and a given rate of lower alkane charged, the temperature of catalyst in the central dehydrogenation/stripping stage of the ECCS is most preferably controlled at about 1100° (593° C.) by the temperature to which the charge is preheated.

While catalyst flows to the ECCS from both the reactor and the regenerator, the bulk of the heat load is supplied to the ECCS from the regenerator. This is in accordance with the objects of the present invention, namely to directly cool the catalyst in the regenerator by circulating catalyst withdrawn from the regenerator through an endothermic alkane thermal dehydrogenation stage, as well as to effect desorption of cracked products from spent catalyst at elevated temperature, while minimizing steam deactivation of the cracking catalyst.

The superficial velocity of alkane in the ECCS central dehydrogenation/stripping stage is preferably in the range from about 0.3 to 5 ft/sec, and that of the steam in the lower steam stripping stage is up to about 0.2 ft/sec. It will be found that a lower superficial velocity than 0.3 ft/sec of alkane is not generally economical, and neither is more than 0.2 ft/sec of steam.

The preferred conditions of operation of the ECCS are such that about 70% of the alkane fed is converted per pass at a WHSV which is no greater than 1 $hr^{-1}$. Higher conversions are obtained with butane-rich feeds, and lower conversions with ethane-rich feeds.

As may be expected in a thermal dehydrogenation reaction, the conversion and selectivity depends mainly upon the specific process conditions of operation of the ECCS, and only to a minor extent upon the particular FCC catalyst being used, unless the catalyst is promoted with specific promoters which enhance the dehydrogenation activity of the FCC catalyst. Most preferred promoters for a faujasite catalyst are nickel and vanadium oxides. Since FCC catalyst captures nickel and vanadium in the FCC feed, dehydrogenation activity of the FCC catalyst is enhanced after it is regenerated. In all instances, the selectivity of conversion from propane to propylene decreases as the conversion increases at a preselected temperature. Also, propane conversion increases as the reaction temperature increases or space velocity decreases. The extent of side reactions such as propane cracking, oligomerization of propylene and ethylene, dehydrogenation of ethane, and isomerization of $C_4$ products may be reduced at higher space velocity, but at the expense of propane conversion. In most instances, even when conversion is relatively high, unconverted propane is preferably recycled to the ECCS.

EXAMPLE

The following illustrative example describes a FCC unit processing 2000 barrel/hour of gas oil/resid feed in conjunction with a single stage regenerator. The dense bed of the regenerator has an inventory of 150 short tons (136.07 metric tons) of catalyst.

A faujasite FCC catalyst with nickel (>2000 ppm) is used which is to be regenerated at a temperature no higher than 1500° F. (815° C.) to prevent damage to the catalyst. The catalyst is to be conveyed to the riser of the cracker at a temperature of 1250° F. (746° C.).

Accordingly, 10 tons/minute of hot regenerated catalyst and 20 tons/minute of spent catalyst are withdrawn from the regenerator and reactor stripper, respectively, and mixed into the ECCS while 1000 lb/min (453.6 kg/min) of a lower alkane feedstream which is preheated to a temperature of 500° F. (260° C.) by heat exchange (not shown) with products from the overhead effluent of the cracker, are used to maintain the catalyst in the upper mixing stage and the central dehydrogenation stage of the ECCS in a fluidized regime. The particular level of turbulence is not critical so long as the fluidization regime within the stage is sub-transport, but it is preferred that the regime be sufficiently turbulent that the fluidization is adequate to efficiently contact the hot catalyst with the alkane-rich feedstream to endothermically dehydrogenate at least 50% by weight, preferably about 70% by weight, of the alkanes in the central dehydrogenation stage while effecting the necessary heat transfer to cool the mixture of spent and regenerated catalyst.

Thus the ECCS provides a means for adding cooling capacity to an existing regenerator, reducing the flow of valuable products to the regenerator and concurrently upgrading a lower value alkane stream. The ECCS permits processing of heavier feedstock to the FCC which will deposit more carbon on the FCC catalyst. The additional heat released by burning off the incremental carbon is removed in the ECCS via the endothermic conversion of alkanes to more valuable olefins. Further, the ECCS decreases the heat load on the catalyst regenerator by more thoroughly stripping the spent catalyst of entrained hydrocarbons than is possible in previous processes.

The process conditions in the ECCS enable the refiner to control the conversion of $C_2$–$C_4$ alkanes in the feedstream so that the effluent from the ECCS which comprises alkanes, olefins and hydrogen including minor amounts of aromatics and cycloaliphatics, may be used as feedstock to be upgraded in other sections of the refinery.

The regenerator dimensions and temperature are as follows:

Height 90 ft. (27.43 meters)

Diameter 25 ft. (7.62 meters)

Hot catalyst removed from regenerator 21,000 lb/min (9,525.6 kg/min), and flowed to ECCS Temperature of hot regen catalyst 1350° F. (732° C.)

The dimensions of the ECCS and conditions of operation with the faujasite catalyst are as follows:

Height: 35 ft (7.62 m)

Diameter: 10 ft (3.05 m)

Upper Mixing Stage

Height of fluidized bed: 10 ft (3.05 m)

Density of fluidized bed: 35 lb/ft$^3$ (570 kg/m$^3$)

Central Dehydrogenation/Stripping Stage

Height of fluidized bed: 10 ft (3.05 m)

Density of fluidized bed: 35 lb/ft$^3$ (570 kg/m$^3$)

Average temperature of dehydrogenation stage: 1100° F. (593° C.)

Superficial velocity of alkane in ECCS: 1 ft/sec (0.3 m/sec)

WHSV: 1 hr$^{-1}$ based on catalyst

Lower Steam Stripping Zone

Height of fluidized bed: 10 ft (3.05 m)

Density of fluidized bed: 35 lb/ft$^3$ (570 kg/m$^3$)

Average temperature of stripping stage: 1075° F. (580° C.)

Superficial velocity of steam: 1 ft/sec (0.3 m/sec) 1 ft/sec

WHSV: 5 hr$^{-1}$ based on catalyst

Temperature of cooled ECCS catalyst charged to regenerator: 1075° F. (580° C.).

Changes and modifications in the specifically described embodiments can be carried out without departing from the scope of the invention which is intended to be limited only by the scope of the appended claims.

What is claimed is:

1. A fluid catalytic cracking process for cracking hydrocarbons comprising the steps of:

(a) cofeeding active hot solid zeolite cracking catalyst and crackable hydrocarbon feed to a cracking zone;

(b) cracking said feed to hydrocarbon products while depositing coke on said catalyst to evolve spent catalyst;

(c) disengaging said spent catalyst from said hydrocarbon products;

(d) flowing said spent catalyst to a regeneration zone;

(e) passing an oxygen-containing gas upwardly through said regeneration zone at sufficient velocity to fluidize said catalyst contained within said regeneration zone;

(f) retaining said catalyst in said regeneration zone at elevated temperature for a time sufficient to effect exothermic oxidative regeneration of said catalyst by burning said coke deposited thereon, thereby heating and reactivating said catalyst;

(g) providing a catalyst stripping zone comprising three superimposed stages, said stages comprising an upper mixing stage, a central dehydrogenation/-stripping stage, and a lower steam stripping stage;

(h) mixing spent catalyst of step (c) with regenerated catalyst of step (f) in said upper mixing stage of said catalyst stripping zone;

(i) retaining said mixture of step (h) within said upper mixing stage at elevated temperature for a period of time sufficient to effect desorption of cracked products from said spent catalyst;

(j) flowing said catalyst mixture of step (i) downwardly to said central dehydrogenation/stripping stage;

(k) introducing a stream containing $C_2$–$C_4$ alkanes to a lower section of said central dehydrogenation/-stripping stage and flowing said stream containing $C_2$–$C_4$ alkanes upwardly in countercurrent contact with said catalyst mixture at superficial velocity adequate to maintain said catalyst in a state of subtransport fluidization, and to strip cracked products from said spent catalyst while providing sufficient contact time between said catalyst mixture and said $C_2$–$C_4$ alkane-containing stream to cool said catalyst mixture by endothermically dehydrogenating at least a portion of alkanes present in said central dehydrogenation/stripping stage to evolve a dehydrogenated product stream;

(l) flowing said cooled catalyst mixture of step (k) from said central dehydrogenation/stripping stage downwardly to said lower steam stripping stage and flowing said dehydrogenated product stream upwardly to said upper mixing stage;

(m) introducing steam to a bottom portion of said lower steam stripping stage and flowing said steam upwardly at superficial gas velocity sufficient to fluidize said catalyst mixture and to countercurrently steam strip said downwardly flowing catalyst mixture to remove hydrocarbons from said catalyst mixture;

(n) withdrawing steam and stripped hydrocarbons from an upper portion of said lower steam stripping stage to prevent substantial flow of steam and stripped hydrocarbons upward from said lower steam stripping stage to said central dehydrogenation/stripping stage and further to minimize steam deactivation of said zeolite cracking catalyst within said catalyst cooling/stripping zone.

2. The process of claim 1 wherein the weight ratio of regenerated catalyst to spent catalyst charged to said upper mixing stage is from about 0.5:1 to about 4:1.

3. The process of claim 1 further comprising controlling the flowrates of regenerated catalyst to spent catalyst charged to said upper mixing stage to maintain the temperature of said upper mixing stage from about 950° F. to about 1400° F.

4. The process of claim 1 wherein said alkane-containing stream of step (k) comprises at least 50% by weight of $C_4$-alkanes.

5. The process of claim 4 wherein said alkane-containing stream of step (k) comprises at least 70% by weight of $C_4$-alkanes.

6. The process of claim 1 wherein the process conditions of said dehydrogenation/stripping stage include weight hourly space velocity based on catalyst of from about 0.01 to about 5.0 $hr^{-1}$ and temperature of from about 1000° F. to about 1200° F..

7. The process of claim 6 further comprising controlling the flowrate of said $C_2$–$C_4$ alkane-containing stream to provide upward superficial gas velocity within said dehydrogenation/stripping stage of from about 0.3 to about 5 ft/sec.

8. The process of claim 7 further comprising controlling the process conditions within said dehydrogenation/stripping stage to provide a turbulent subtransport fluidization regime.

9. The process of claim 1 further comprising controlling the rate of steam introduction to said lower steam stripping stage to provide steam superficial velocity within said lower steam stripping zone of less than about 0.2 ft/sec.

10. A fluid catalytic cracking process comprising the steps of:

(a) admixing hot zeolite cracking catalyst with a crackable hydrocarbon feed in the lower section of a reactor riser;

(b) flowing said admixture of step (a) upwardly through the length of said reactor riser to contact said crackable feed with said zeolite cracking catalyst for a period of time sufficient to effect conversion of crackable hydrocarbons to cracked products while deactivating said cracking catalyst by depositing coke thereon;

(c) disengaging said deactivated catalyst from said cracked products;

(d) flowing a first portion of said deactivated catalyst to a regeneration zone under regeneration conditions including pressure from about 20 psig to about 50 psig and temperature from about 1200 to about 1500° F. while injecting sufficient oxygen-containing regeneration gas into said regeneration zone to maintain a dense fluid bed of cracking catalyst in said regeneration zone and to oxidatively regenerate said cracking catalyst;

(e) providing a catalyst cooling/stripping zone external both to said regeneration zone and to said reactor riser, said catalyst cooling/stripping zone comprising an upper mixing stage superimposed over a central dehydrogenation/stripping stage superimposed over a lower steam stripping stage;

(f) flowing a second portion of said deactivate catalyst to said upper mixing stage of said catalyst cooling/stripping zone;

(g) withdrawing a controlled stream of regenerated cracking catalyst from said regeneration zone and introducing said withdrawn regenerated catalyst into said upper mixing stage to admix said withdrawn regenerated catalyst with said second portion of said deactivated catalyst;

(h) controlling the relative flowrates of said regenerated cracking catalyst and said deactivated catalyst to maintain temperature within said upper mixing stage from about 1050 to about 1250° F.;

(i) flowing said catalyst mixture downwardly from said upper mixing stage to said dehydrogenation/stripping stage at a rate relative to the combined charged rates of spent and regenerated catalyst to said upper mixing stage such that the residence time of said catalyst mixture within said upper mixing stage is sufficient for the desorption of at least 10% by weight of hydrocarbons sorbed onto said deactivated catalyst while concomitantly conveying sensible heat to said dehydrogenation/stripping stage sufficient to provide the endothermic heat of reaction of rehydrogenation of alkanes in said dehydrogenation/stripping stage;

(j) introducing a feedstream containing said alkanes into said dehydrogenation/stripping stage to maintain said catalyst mixture in a state of fluidization within said dehydrogenation/stripping stage, said state of fluidization existing in a sub-transport regime operating at a weight hourly space velocity (WHSV) of said alkanes up to about 5 $hr.^{-1}$ while maintaining said dehydrogenation/stripping stage at a temperature sufficient to convert at least 50% by weight of said alkanes, and concurrently to cool said catalyst mixture while stripping cracked products from said catalyst mixture;

(k) transporting said cooled catalyst mixture directly from said dehydrogenation/stripping stage, said catalyst mixture now at a temperature from about 1100 to about 1350° F., to said lower steam stripping stage;

(l) countercurrently stripping said cooled catalyst mixture by flowing steam upwardly in contact with generally downwardly flowing catalyst to remove entrained hydrocarbons from said catalyst mixture; and (m) withdrawing steam and stripped hydrocarbons from said lower steam stripping stage to avoid substantial flow of steam upward to said dehydrogenation/stripping and mixing stages and further to minimize steam deactivation of said zeolite cracking catalyst within said catalyst cooling/stripping zone.

* * * * *